US006942755B2

(12) United States Patent
Basler et al.

(10) Patent No.: US 6,942,755 B2
(45) Date of Patent: Sep. 13, 2005

(54) METHOD FOR FABRICATING AN EMBOSSED SHEET OF CELLULOSE TISSUE, A PRODUCT SO MADE AND AN EMBOSSING CYLINDER

(75) Inventors: Michel Basler, Colmar (FR); Pierre Graff, Wolfgantzen (FR); Benoît Hoeft, Bischwihr (FR); Sébastien Jeannot, Colmar (FR)

(73) Assignee: Georgia-Pacific France, Kunheim (FR)

( * ) Notice: Subject to any disclaimer, the term of this patent is extended or adjusted under 35 U.S.C. 154(b) by 0 days.

(21) Appl. No.: 10/179,947

(22) Filed: Jun. 26, 2002

(65) Prior Publication Data

US 2003/0008109 A1 Jan. 9, 2003

(30) Foreign Application Priority Data

Jun. 29, 2001 (EP) ..... 01401741

(51) Int. Cl.[7] ..... B31F 1/07

(52) U.S. Cl. ..... 162/117; 162/123; 162/132; 162/111; 156/219; 156/209

(58) Field of Search ..... 162/109, 117, 162/111–113, 361–362, 115–116, 123, 132, 133, 204–205; 156/205, 209, 219, 553, 555, 582; 428/172, 178, 152–153

(56) References Cited

U.S. PATENT DOCUMENTS 4,978,565 A * 12/1990 Pigneul et al. ..... 428/156
5,620,776 A 4/1997 Schulz
5,686,168 A * 11/1997 Laurent et al. ..... 428/179
5,840,404 A * 11/1998 Graff ..... 428/154
5,846,636 A * 12/1998 Ruppel et al. ..... 428/154
5,874,156 A 2/1999 Schulz
6,080,276 A * 6/2000 Burgess ..... 162/117
6,106,928 A * 8/2000 Laurent et al. ..... 428/152
6,173,496 B1 1/2001 Makoui et al.
6,176,819 B1 1/2001 Boegli et al.
6,277,466 B1 * 8/2001 McNeil et al. ..... 428/154
6,302,998 B1 * 10/2001 Burgess ..... 162/109
6,306,482 B1 * 10/2001 Ruppel et al. ..... 428/154
6,470,945 B1 * 10/2002 Biagiotti ..... 156/553
6,524,683 B1 * 2/2003 Roussel et al. ..... 428/172
6,599,614 B1 * 7/2003 Roussel et al. ..... 428/172
2003/0008109 A1 * 1/2003 Basler et al. ..... 428/156
2003/0021953 A1 * 1/2003 Graff ..... 428/153
2003/0118782 A1 * 6/2003 Graff ..... 428/172
2005/0034828 A1 * 2/2005 Graff et al. ..... 162/123

FOREIGN PATENT DOCUMENTS

DE 199 60 658 A1 6/2001

* cited by examiner

*Primary Examiner*—José A. Fortuna
(74) *Attorney, Agent, or Firm*—Breiner & Breiner, L.L.C.

(57) ABSTRACT

The invention relates to a method for manufacturing a sheet of paper tissue which is embossed by an embossing cylinder of which the surface is fitted at least in part with embossing elements. The elements include a frustoconical base portion and a tip portion. The method is characterized in that the tip segment includes a flat of which the area is less than 75% of the smaller cross-sectional area of the base. Preferably the area of the flat is less than 20% of the base cross-sectional area. The invention furthermore concerns a sheet thusly manufactured and to sheets made of several plies of which at least one is a ply of the invention.

11 Claims, 3 Drawing Sheets

METHOD FOR FABRICATING AN EMBOSSED SHEET OF CELLULOSE TISSUE, A PRODUCT SO MADE AND AN EMBOSSING CYLINDER

FIELD OF INVENTION

The present invention relates to sanitary or household papers, in particular to a manufacturing method for an absorbent creped cellulose sheet of tissue paper with an embossed pattern. Furthermore, the invention concerns a product so made and a cylinder with which to implement the method.

BACKGROUND OF INVENTION

Paper tissue, also called cellulose wadding, is an absorbent paper of low specific surface weight between 15 and 35 g/m$^2$ which may be manufactured to offer some stretching capacity. A conventional procedure adds glue to a still wet sheet and applies the sheet against a drying cylinder and then detaches it from the cylinder by a scraper blade in order to imprint crepe corrugations. Thereupon, the sheet's properties, such as softness, flexibility, absorption, thickness and appearance, may be improved or at least be modified using known embossing procedures.

Embossing is carried out either on a highly moist paper, that is in the wet portion of a papermaking machine, or on paper of low moisture, that is when being transformed in its dry mode. The present invention concerns embossing low moisture paper. Most commonly an embossing pattern consists of protrusions or bosses in the form of cross-sectionally square pyramids or cross-sectionally round or oval frustra of cones, which are distributed regularly or otherwise on the sheet's surface. It is noted that a protrusion on one side of the sheet corresponds to a cavity on the other side.

In a first technique, embossing tissue paper is carried out using a generally rigid cylinder fitted at its surface with embossing tips. The sheet is applied against the cylinder and compressed by another cylinder fitted with deforming cladding, such as rubber. In this manner the sheet is made to match the first cylinder's topography. For a given embossing pattern, the deformation is more or less pronounced depending on the parameters that were selected, namely the rubber's flexibility, its deformability and its ability to match the engraved topography, and the embossing pressure.

In another technique, two cylinders are fitted at their respective surfaces with mutually complementary topographies, namely male and female.

The embossing tips are made by engraving the cylinder, for example, using a knurling tool which itself is engraved. Depending on the particular material used, the embossing tips also may be machined directly.

The embossing tips assume a generally cross-sectionally frustoconical circular or oval shape or a pyramidic, cross-sectionally square shape. The half angle at the apex of an inscribed cone is typically between 25° and 35°. The embossing tips' dimensions, their distribution, their density (their number per unit area), are selected as a function of the desired product performance.

Illustratively, if it is desired to impart a textile appearance to a sheet and to flexibilize it without particularly improving its absorptivity, very shallow heights are selected for the embossing tips, namely between 0.4 and 0.6 mm and they are distributed in a high density pattern (more than 30, even 80 embossing tips per cm$^2$). On the other hand, as regards a paper used for wiping, in particular a paper towel, the sheet is substantially deformed in order to create air pockets between the plies following their assembly. The pockets appreciably enhance the absorption of the tissue paper. In that case, the tip height may be as large as 2.5 mm while the pattern density will be low, less than 10 tips/cm$^2$. In this manner an embossing pattern consisting mostly of frustoconical embossing tips is characterized simultaneously by its height and by its density.

When the sheet is deformed beyond its elastic limit, part of the links between the paper fibers are always destroyed. Any embossing therefore entails a loss in paper tear-strength. On the other hand, the number of links having decreased, the sheet shall be more flexible.

When cellulose tissue paper is embossed using an embossing assembly of an engraved cylinder and a rubber cylinder, the sheet deformation, hence its thickness, depends on the pressure applied by the rubber cylinder. For a given pattern, the drop in tear strength therefore is related to the attained embossing thickness and becomes greater with it. This is especially the case at the maximum values. A maximum thickness corresponds to maximum loss of tear strength.

OBJECTS AND BRIEF SUMMARY OF INVENTION

Therefore, a primary object is to improve the embossing thickness for a given pattern and at a given embossing pressure. In other words, the greatest thickness with the least drop in tear strength is sought.

Another object is to increase the maximum embossing thickness of a given pattern.

These goals are attained thanks to the manufacturing method of the invention. This method, whereby a sheet is embossed by an embossing cylinder fitted over at least part of its surface with embossing elements that exhibit a frustoconical base portion and a tip portion, is characterized in that the tip portion comprises a flat of which the area amounts to 0.01 to 75% of the smaller cross-sectional area of the base portion.

The flat is the distal surface of the embossing element and generally is planar or exhibits a large radius of curvature.

In another feature of the invention, the contour of the surface of the tip portion which joins the base portion to the flat is curved in order to preclude sharp edges between the frustrum portion and the flat.

In particular the flat's width is less than 20%. It was observed that the stresses applied to the sheet are better distributed when reducing the flat's area, when taking into account other technical imperatives, for example the need to apply a film of adhesive to bond one ply to another. In a particular embodiment of the invention, the flat's area is reduced to a dot. This embodiment is appropriate for a sheet that is not glued at the tips of the protrusions.

In the prior art, U.S. Pat. No. 3,414,459 describes a sheet of paper consisting of two embossed plies that are mutually configured so that the protrusions are arrayed tip to tip. The figures of this patent show the engraved embossing elements at the surfaces of the embossing cylinder. These embossing elements exhibit a substantially cross-sectional rectangular cylindrical geometry where the two parallel plane surfaces point in the direction of machine advance. The embossing elements are flat and include a rounded portion. It appears the radii of curvature both in the direction of advance and in the transverse direction shown in the figures are different. It is noted that the parallelipipedic geometry of the embossing elements entails shearing stresses applied to the sheet, the stresses in turn entailing significant degradation of the sheet's mechanical strength. On the other hand, the invention on account of its optimal embossing element geometry allows improving the sheet's properties.

The manufacturing method of the invention also applies to industry. With given machinery, and using the embossing element of the invention, and at the same embossing pressure, the thickness can be increased by as much as 15%. As a result, industrial application is made easier since the pressure can be reduced. The rubber wears less. Alternatively, more thickness is available in case of need.

In another feature of the invention, the density of the embossing elements pattern is between 20 and 100/cm$^2$, the height of the elements being between 0.1 and 1.5 mm, in particular between 0.1 and 0.6 mm. The solution of the invention is especially advantageous as regards micro-embossing patterns because the fine embossing elements exhibit some perforation tendencies. Therefore the embossing pressure can be increased without the danger of piercing the sheet.

The present invention also relates to the sheet made by the above method. In particular and according to one feature of the invention, a first ply embossed by embossing elements practically devoid of flats is combined with a second ply embossed by embossing elements fitted with a flat of sufficient size to accept a film of adhesive. This solution allows maximum reduction of embossing-caused loss in strength in the first ply.

Other features and advantages are elucidated in the following description of an embodiment of the invention and in relation to the attached drawings.

DETAILED DESCRIPTION OF PRESENTLY PREFERRED EMBODIMENTS

Figure 1:
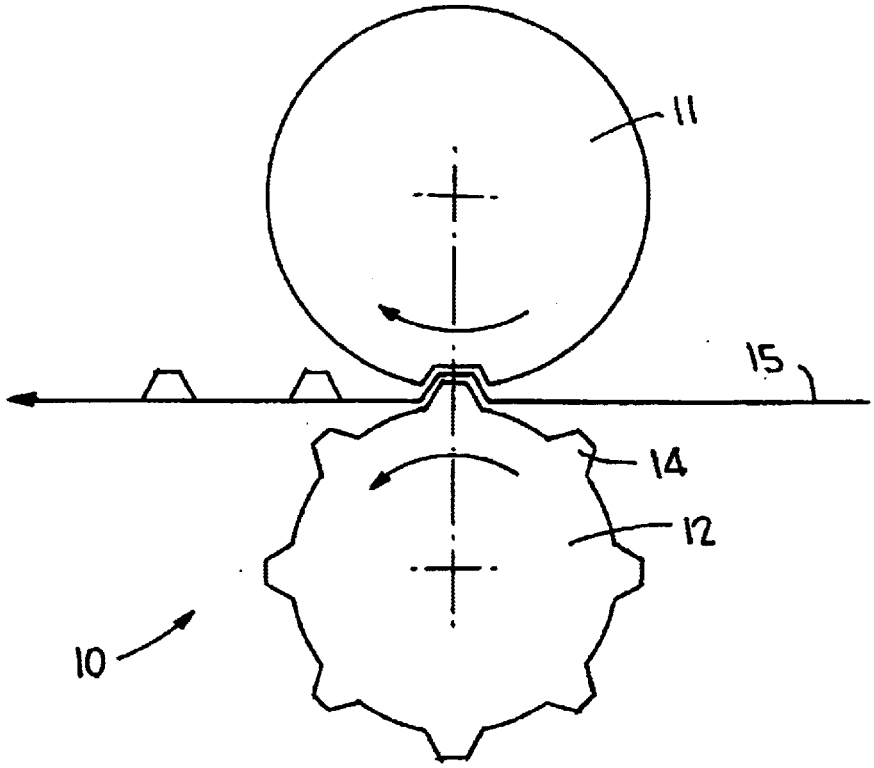
FIG. 1 schematically shows an embossing assembly with which to carry out the method of the invention.

FIG. 1 schematically shows an embossing assembly 10 for a sheet 15. A first cylinder 12 is made of steel or other rigid material and includes at its surface embossing elements 14 shown exaggeratedly large in this Figure. A cylinder 11 consisting of rubber or any material deforming under pressure is mounted parallel to the first cylinder 12 and rotates fairly tightly with it. A sheet of cellulose tissue paper which is to be embossed is engaged between the two cylinders. The sheet 15 may be a single ply or two or more superposed plies. Each of the plies consists of creped cellulose tissue paper exhibiting a specific surface weight between 15 and 35 g/m$^2$. The creping ratio is appropriate to allow embossing. In between the two cylinders, the sheet is deformed by the embossing elements of which it assumes the shapes.

Figure 2A:
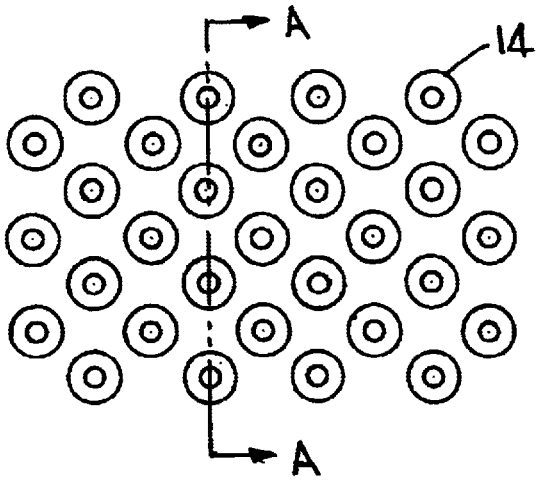
FIG. 2*a* is a top view of the embossing elements of the invention over part of an engraved cylinder's surface.
Figure 2B:
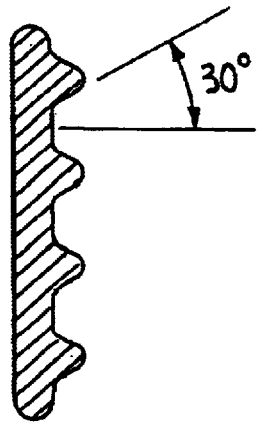
FIG. 2*b* is a view along section A—A of FIG. 2*a*.
Figure 3:
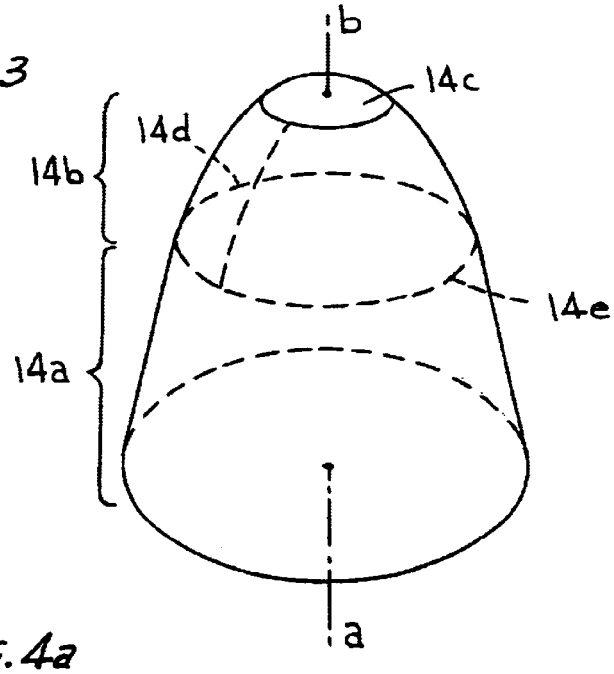
FIG. 3 is a perspective of an embossing element of the invention.

As regards FIGS. 2 and 3, they show an illustrative embodiment of the embossing elements of the invention. FIGS. 2*a* and 2*b* show embossing elements 14 at the cylinder's surface. FIG. 2*a* is a partial, geometrically developed top view of the surface of the engraved cylinder 12. It shows the embossing elements 14 which in this example assume the form of a mutually staggered array in both the direction of advance and the transverse direction. The pattern shown is very dense, the inter-distance of the embossing elements are respectively, 1.75 mm and 1.4 mm for an element height of 0.5 mm. An embossing element 14 is shown in a transparent view in FIG. 3. There are two portions, namely a base portion 14a and a tip portion 14*b*. The base 14*a* is frustoconical with an axis "ab". The half-angle at the tip of the frustoconical surface in this example is 30°. The portion 14*a* is extended by a tip portion 14*b* which at its summit assumes the form of a flat 14*c*. The contour of portion 14*b*, which is situated between the flat 14*c* and the base portion 14*a*, is curved. Advantageously the contour may be an are of a circle. Preferably the contour 14*d* is tangent to the frustoconical portion 14*a* along the virtual separation line 14*e* between the two portions 14*a* and 14*b*. According to the invention, the area of the flat 14*c* at most is equal to 75% of the area bounded by the closed line 14*e*. Preferably it is less than 20% of the area bounded by 14*e*. It may be advantageous to reduce the flat to a point of a value of 0.01%: Without being restricted to this hypothesis, by reducing the summit area, the rubber compressing the sheet can progressively deform along the embossing element and thereby can deform the sheet more homogeneously. As a result, fewer weak zones in the sheet are incurred. Therefore, the loss of strength is less.

Several tests were run to confirm the above hypothesis.

A first visual test was run on a prototype assembly including a cylinder fitted with embossing elements in the manner of the above embodiment, namely:

80 embossing elements/cm$^2$, height of 0.5 mm, and a tip portion in the form of a dome of 0.2 mm radius.

Figure 4A:
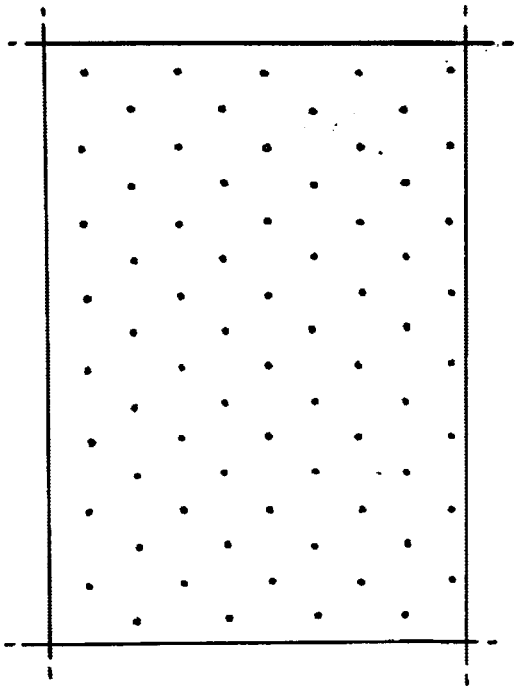
FIG. 4*a* shows the imprint of the pattern of the invention on a pressure-sensitive sheet.
Figure 4B:
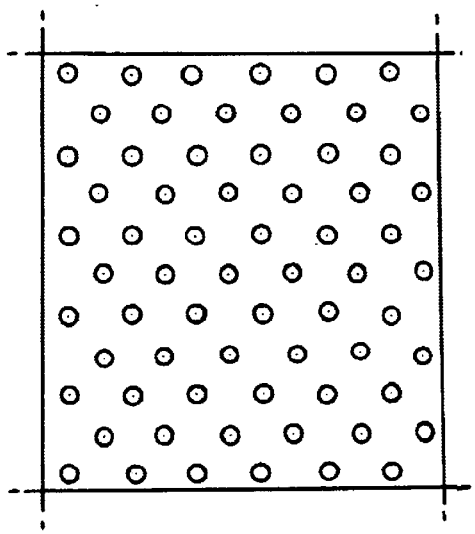
FIG. 4*b* shows the imprint of a pattern of the prior art on a pressure-sensitive sheet.

Dynamic imprint tests were run at a machine speed of 50 m/min on a sheet of carbon-free reproducing paper. This imprint is shown in FIG. 4*a*. For comparison, imprints with an identical pattern were made, however the embossing element summits were standard with a flat corresponding to that of the cone frustrum. Such a pattern exhibits the following features: 80 embossing elements/cm$^2$, each embossing element being 0.5 mm high, and the embossing elements being in the shape of a frustrum of a cone of which the flat is a disk of 0.2 mm radius. This imprint is shown in FIG. 4*b*. It is noted that the imprints of the embossing elements of the invention are reduced to points whereas those of the prior art are much different. The imprints subtend a ring. All the summit periphery appears crushed.

Other comparison tests were run with the same patterns at different embossing pressures. A width of the rubber mark on the steel cylinder corresponds to a given embossing pressure. Within the technical field of the present invention, the embossing pressure therefore is commonly defined by the width of the mark, which also is called imprint. In this manner, there are five imprints: 20, 25, 30, 35 and 39 mm. Thereupon a ply thusly embossed was glued to an unembossed ply of the same cellulose tissue paper (column I1). For comparison, a product of the same structure was manufactured but with a pattern of the prior art (column A1). The table below shows that for a given imprint, that is for a given machine adjustment, a product (column I1) is attained which offers a thickness exceeding that of a product made by the prior art (column A1). The illustrative implicit advantage of the invention is that cylinder loads may be lowered. In particular, there is less rubber wear.

Moreover, as regards the maximum pressure setpoint, that is an imprint of 39 mm, the thickness of the embossing elements of the invention are from 10 to 15% larger. In this manner, the invention offers a potential, additional thickness. Again, at a given value of transverse mechanical strength, the thickness is greater, and this applies especially at the greater thicknesses. Lastly, keeping the thicknesses constant, the embossed paper is stronger.

| Imprint, mm | A1: thickness, mm | A1, transverse strength in N/m | I1 thickness, mm | I1, transverse strength, N/m |
|---|---|---|---|---|
| 20 | 0.27 | 116 | 0.29 | 114 |
| 25 | 0.31 | 107 | 0.34 | 102 |
| 30 | 0.35 | 102 | 0.40 | 93 |
| 35 | 0.41 | 90 | 0.45 | 86 |
| 39 | 0.42 | 84 | 0.48 | 82 |

The same tests were run under the same conditions except that an embossed ply and an unembossed ply were joined by knurling. The table below shows that similar results ensue, namely see column A2 for the product of the prior art and column I2 for the product of the present invention.

| Imprint, mm | A2: thickness, mm | A2, transverse strength in N/m | I2 thickness, mm | I2, transverse strength, N/m |
|---|---|---|---|---|
| 20 | 0.28 | 102 | 0.31 | 97 |
| 25 | 0.33 | 96 | 0.35 | 90 |
| 30 | 0.37 | 84 | 0.41 | 78 |
| 35 | 0.42 | 75 | 0.45 | 74 |
| 39 | 0.42 | 68 | 0.46 | 70 |

Figure 5:
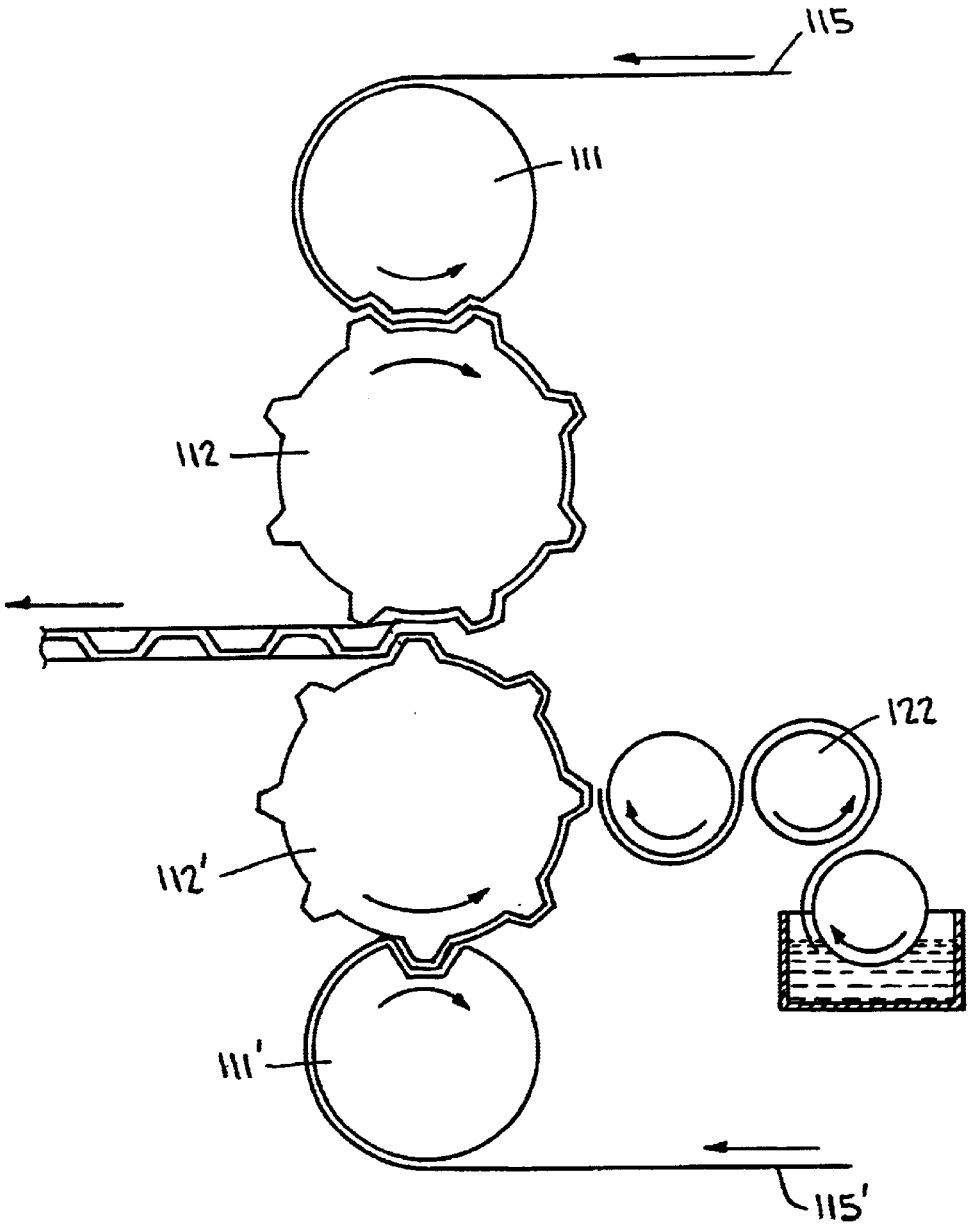
FIG. 5 shows machinery with which to manufacture a sheet of several plies.

FIG. 5 shows machinery with which to manufacture a sheet of several plies of which at least one ply is embossed in the manner of the invention. A first embossing assembly containing an engraved cylinder 112 and a rubber clad cylinder 111' operates in concert with a second embossing assembly 112' and 111'. An adhesive depositing system applies adhesive to the summits of the protrusions of one of the two assemblies. It is understood that either or both assemblies can be fitted with the embossing elements of the invention. To best exploit the advantages of the invention, illustratively in the case of a household paper towel, the embossing elements fitted with wholly rounded summits can be fitted onto the assembly 111/112 and remain free of adhesive and a given area shall be preserved at flats of the assembly 111'/112' which does receive adhesive.

As will be apparent to one skilled in the art, various modifications can be made within the scope of the aforesaid description. Such modifications being within the ability of one skilled in the art form a part of the present invention and are embraced by the appended claims.

What is claimed is:

1. A method for manufacturing a sheet of paper tissue including at least a first ply of tissue and a second ply of tissue comprising embossing said first ply of tissue using an embossing cylinder having a surface of which at least a portion has embossing elements that comprise a frustoconical base portion and a tip portion, wherein said tip portion has a curved contour and a flat at a free end of the tip portion, the flat having a surface less than 75% of the smaller cross-sectional area of the base portion, applying adhesive on said flat, and combining therewith said first ply and said second ply.

2. Method as claimed in claim 1, wherein the flat has a surface less than 20% of the smaller cross-sectional area of the base segment.

3. Method as claimed in claim 1, wherein the tip portion has a contour between the base portion and the flat which is a convex curve.

4. Method as claimed in claim 3, wherein said contour is an arc of a circle.

5. Method as claimed in claim 1, wherein a half-angle at a top of the frustoconical surface of the base portion is between 25° and 35°.

6. Method as claimed in claim 5, wherein said tip portion has a contour of a semi-circle.

7. Method as claimed in claim 5, wherein the top of the base portion is tangent to said tip portion.

8. Method as claimed claim 1, wherein the base portion is circular in cross-section.

9. Method as claimed in claim 1, wherein the embossing elements are present in a density of between 20 and 100/cm$^2$ and have a height of between 0.1 and 1.5 mm.

10. Method as claimed in claim 9, wherein the embossing elements have a height of between 0.1 and 0.6 mm.

11. Method as claimed in claim 1, wherein the embossing elements are present in a density of between 4 and 20/cm$^2$ and have a height of between 1 and 2.5 mm.

* * * * *